US006997114B2

(12) United States Patent
Chang

(10) Patent No.: US 6,997,114 B2
(45) Date of Patent: Feb. 14, 2006

(54) MOVABLE "L" TYPE DESK

(76) Inventor: Chien-Kuo Chang, P.O. Box 36-80, Taichung City (TW)

( * ) Notice: Subject to any disclaimer, the term of this patent is extended or adjusted under 35 U.S.C. 154(b) by 123 days.

(21) Appl. No.: 10/726,036

(22) Filed: Dec. 1, 2003

(65) Prior Publication Data

US 2005/0115474 A1 Jun. 2, 2005

(51) Int. Cl.
*A47B 57/00* (2006.01)

(52) U.S. Cl. ..... 108/64; 108/94

(58) Field of Classification Search ..... 108/64, 108/50.01, 102, 103, 94, 95; 312/198
See application file for complete search history.

(56) References Cited

U.S. PATENT DOCUMENTS 138,406 A * 4/1873 Johnson ..... 108/93
2,160,144 A * 5/1939 Hiller ..... 108/93
2,988,413 A * 6/1961 Bergen ..... 312/195
4,223,613 A * 9/1980 Yoshizawa ..... 108/64
5,943,966 A * 8/1999 Machado et al. ..... 108/64
5,967,058 A * 10/1999 Ambrose et al. ..... 108/64
6,145,448 A * 11/2000 Marschand et al. ..... 108/102
6,161,487 A * 12/2000 Chang ..... 108/50.01
6,497,184 B1 * 12/2002 Whitesitt ..... 108/64

* cited by examiner

*Primary Examiner*—Jose V. Chen
(74) *Attorney, Agent, or Firm*—Charles E. Baxley

(57) ABSTRACT

A movable "L" type desk comprising a main desk with a main desk board on top; an extension desk with an extension desk board on top; the extension desk connects to one of the main leg of the main desk with a connection mechanism rotatably, a rolling wheel is on the bottom of the extension leg; a connection mechanism consists of a main leg of a main desk with a top and bottom leg, a round shaft is on top of the bottom leg, a hollow connecting tube is installed vertically near the open end of an extension beam, at least one rub-resistant ring is inside the connecting tube, the round shaft passes through the rub-resistant ring, the top of the round shaft passes through the rub-resistant ring and connects to a top ring. The main desk and the extension desk are connected in single point rotatably; the extension desk connects to the main desk without the angle and direction limitation

6 Claims, 7 Drawing Sheets

MOVABLE "L" TYPE DESK

BACKGROUND OF THE INVENTION

I. Field of the Invention

This invention relates generally to an "L" type desk and, more specifically, to a movable "L" type desk that comprises of a main and an extension desks connected with a connection mechanism, the extension desk can change the connecting angle with the main desk, or store under the space of the main desk.

II. Description of the Prior Art

In order to increase the usable area on top of the desks, increase convenience of usage and reduce the bulky desk area, the demand of "L" shape arrangement desks ("L" type desk) in the market is increasing. The design of "L" type desks is to have main and attached desks arranged in "L" shape. If the connection is fixed, the attached desk cannot be put away to save space, the relative angle of the main and attached desks cannot be altered as desire. If the connection is movable, the attached desk can be put away, however most of current designs limit the stretching angle and direction between the main and the attached desks, usually the maximum stretching angle between the main and the attached desks is 90°, the attached desk can stretch toward left of right of the main desk; the attached desk can be stored under the space of the main desk, users cannot alter the angle and direction of the attached desk arbitrarily. Many connection structures of the movable "L" type desk are very complex, the assembly is very time consuming, operation is not simple enough and smooth, the inadequate designs might even cause unstable issues.

SUMMARY OF THE INVENTION

It is therefore a primary object of the invention to provide a movable "L" type desk, the main desk and the extension desk are connected in single point rotatably, the extension desk connects to the main desk without the angle and direction limitation, the extension desk can rotate to the end of the main desk, form an "L" type with the main desk, for different angles with the main desk or store under the space of the main desk. The structure of the extension desk is simple and strong; users can move, open or store the extension desk easily.

In order to achieve the objective set forth, a movable "L" type desk in accordance with the present invention comprises a main desk that further consists of a main beam with a main leg each on both ends of the main beam and form a rack on floor, a main desk board is on top of the rack; an extension desk consists of an extension beam with an extension leg on one end, the other end of the extension desk connects to one of the main leg of the main desk with a connection mechanism rotatably, a rolling wheel is on the bottom of the extension leg; a connection mechanism consists of a main leg of a main desk with a top and bottom leg, a round shaft is on top of the bottom leg, a hollow connecting tube is installed vertically near the open end of an extension beam, at least one rub-resistant ring is inside the connecting tube, the round shaft passes through the rub-resistant ring, the top of the round shaft passes through the rub-resistant ring and connects to a top ring, a wing board extends from the bottom of the top ring, two board holes are on the wing board, a shaft hole is on the bottom of the top leg for the top ring and top of the round shaft to pass through, a screw tip with thread each is on both ends of the bottom of the top leg to pass the two board holes and fasten with nuts.

BRIEF DESCRIPTION OF THE DRAWINGS

The accomplishment of the above-mentioned object of the present invention will become apparent from the following description and its accompanying drawings which disclose illustrative an embodiment of the present invention, and are as follows.

DESCRIPTION OF THE PREFERRED EMBODIMENT

Figure 1:
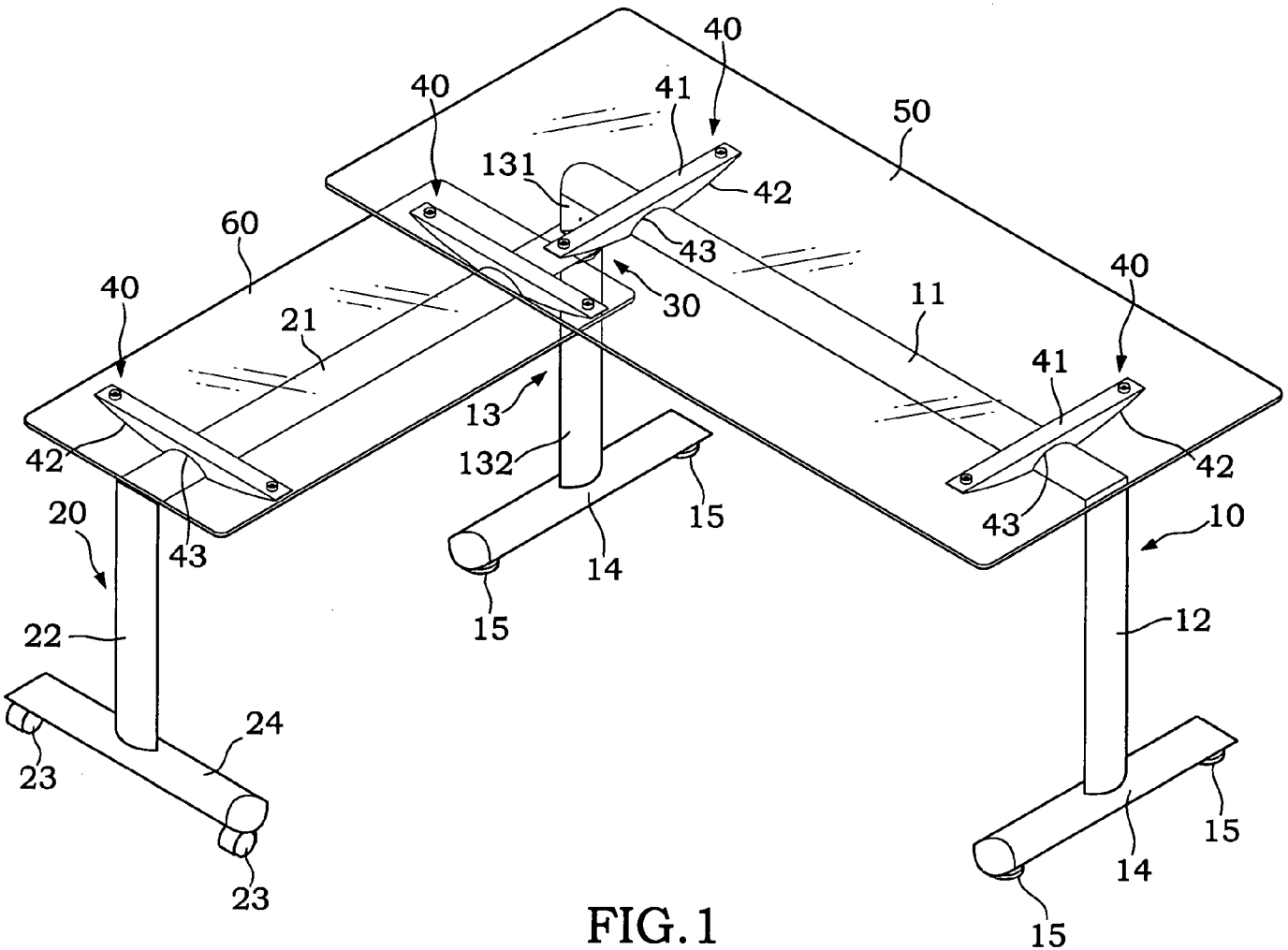
FIG. 1 is the first perspective view of the present invention.
Figure 2:
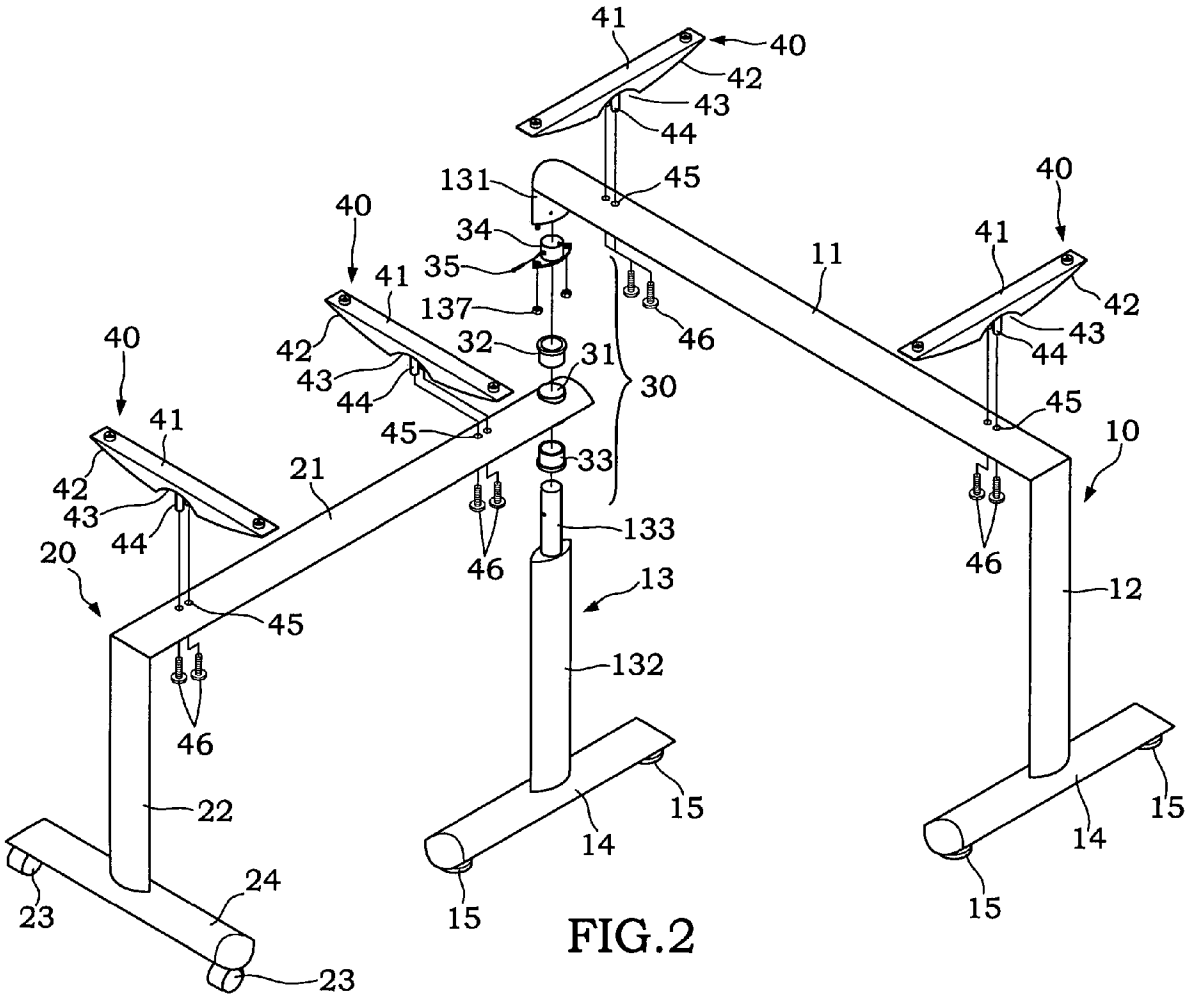
FIG. 2 is an assembly view of the present invention.

The present invention is composed of a main desk 10, an extension desk 20 and a connection mechanism 30. The functions of each component are described below:

Referring to FIG. 1 and FIG. 2, the main desk 10 consists of a main beam 11, a main leg 12, 13 each is on both ends of the main beam 11, on each of the bottom of the main leg 12, 13 connects to the center of a main stretcher 14 horizontally; a stable foot 15 each is on both ends of the bottom of the main stretcher 14; the cross section of the main beam 11, the main leg 12, 13 and the main stretcher 14 is round.

The extension desk 20, as shown in FIG. 1 and FIG. 2, consists of an extension beam 21, an extension leg 22 is on one end of the extension beam 21, on the bottom of the extension leg 22 connects to the center of an extension stretcher 24 horizontally; a rolling wheel 23 each is on both ends of the bottom of the extension stretcher 24; the cross section of the extension beam 21, the extension leg 22 and the extension stretcher 24 is round.

Figure 3:
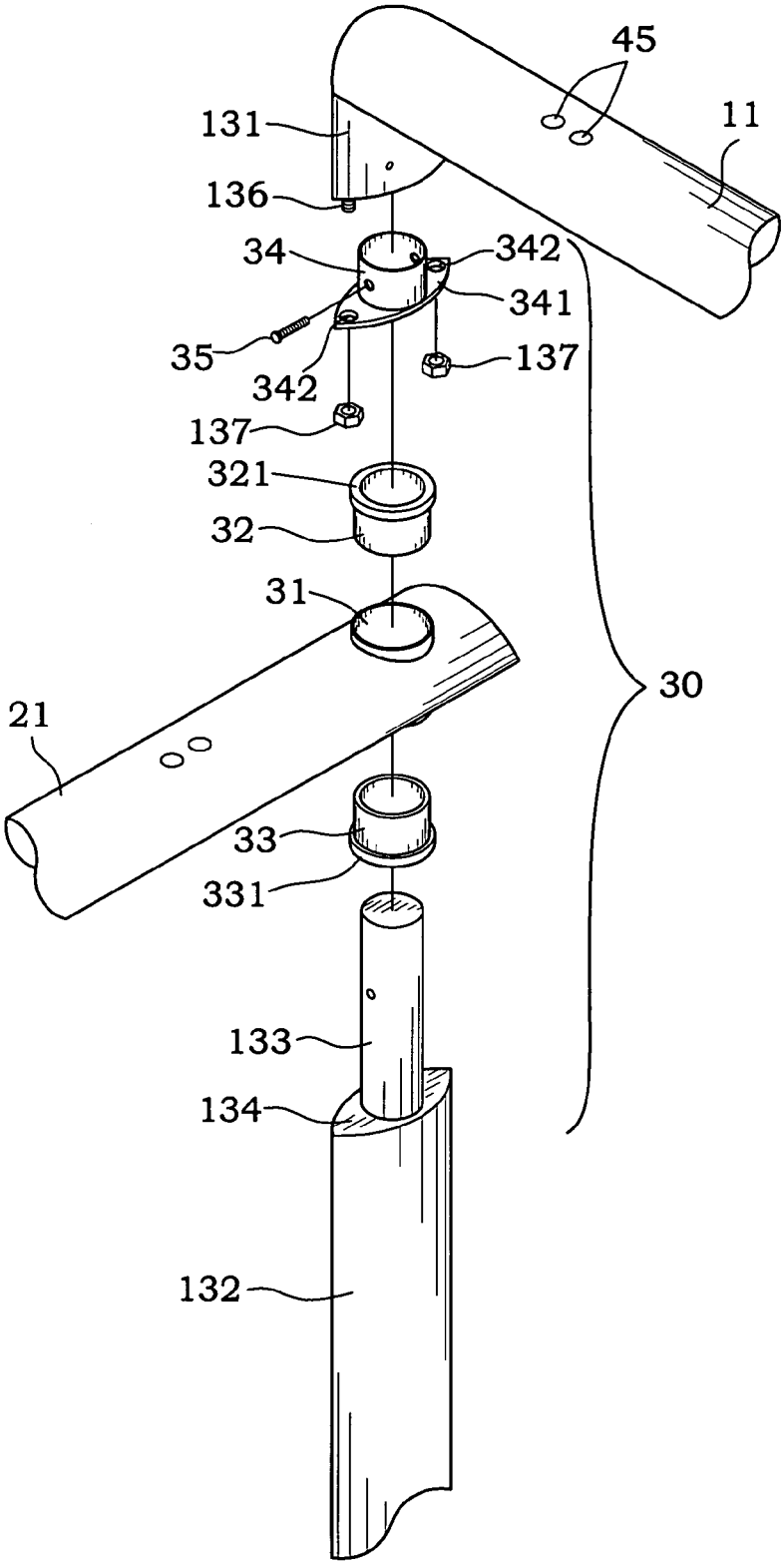
FIG. 3 is an assembly view of a further embodiment of the present invention.
Figure 4:
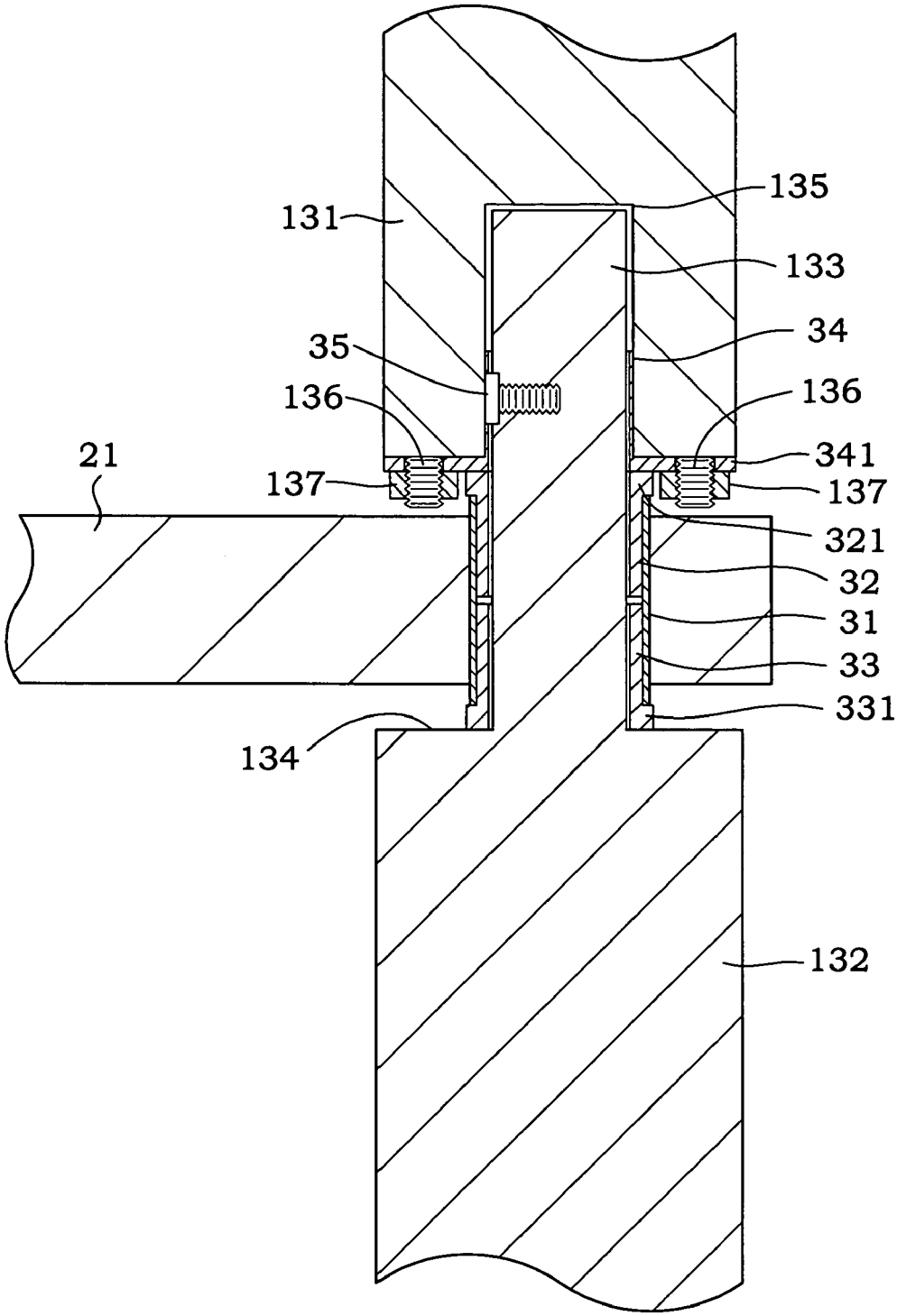
FIG. 4 is a cross-sectional view of a further embodiment of the present invention.

The connection mechanism 30, as shown in FIG. 2, FIG. 3 and FIG. 4, is to combine the open end of the extension beam 21 and one of the main leg 13 into a rolling connection structure. The main leg 13 further comprises of a top, and bottom leg 131, 132; a round shaft 133 is on top of the bottom leg 132, a stopper 134 is on the boundary of the bottom leg 132 and the round shaft 133; a hollow connecting tube 31 is installed vertically near the open end of the extension beam 21, a top and bottom rub-resistant ring 32, 33 made of plastic each is on top and bottom of the connecting tube 31, a top and bottom stop loop 321, 331 each is on one end of the top and bottom rub-resistant ring 32, 33, the top and bottom stop loop 321, 331 locate on both ends of the connecting tube 31 externally; the round shaft 133 passes through both of the top and bottom rub-resistant ring 32, 33, the bottom of the bottom stop loop 331 of the bottom rub-resistant ring 33 connects to the stopper 134, the top of the round shaft 133 passes through the top rub-resistant ring 32 and is covered by a top ring 34, at least one screw 35 fixes the top ring 34 and the top of the round shaft 133 vertically; a wing board 341 each extends on both bottom ends of the top ring 34, a board hole 342 each is on both wing board 341, a shaft hole 135 is on the bottom of the top leg 131 for the top ring 34 and the top of the round shaft 133 to pass through, a screw tip 136 each on one side of the bottom of the top leg 131 passes through the board hole 342 and is fixed with a nut 137; the top leg 131 and the bottom leg 132 are connected together with the top ring 34 and the round shaft 133, the extension beam 21 connects to the main leg 13 rotatably with the connecting tube 31, the top and bottom rub-resistant ring 32, 33.

Several supporting beam 40 are vertically installed on top of the main and extension beam 11, 12, as shown in FIG. 1 and FIG. 2, every supporting beam 40 has a top flat surface 41 and a bottom protruding curve surface 42, an indentation trough 43 corresponding to the shape of the main and extension beam 11, 12 is on the bottom protruding curve surface 42, a turning-resistant pin 44 with thread is on the indentation trough 43, a pin hole 45 each is on the main and extension beam 11, 12 at the location for the supporting beam 40, the turning-resistant pin 44 of the supporting beam 40 is inserted into the pin hole 45, the supporting beam 43 fits completely onto the main and extension beam 11, 12, screw 46 are screwed into the thread of the turning-resistant pin 44, the supporting beam 40 are fixed onto the main and extension beam 11, 12 firmly, the top flat surface 41 sustain a main desk board 50 and an extension desk board 60 respectively.

Figure 5:
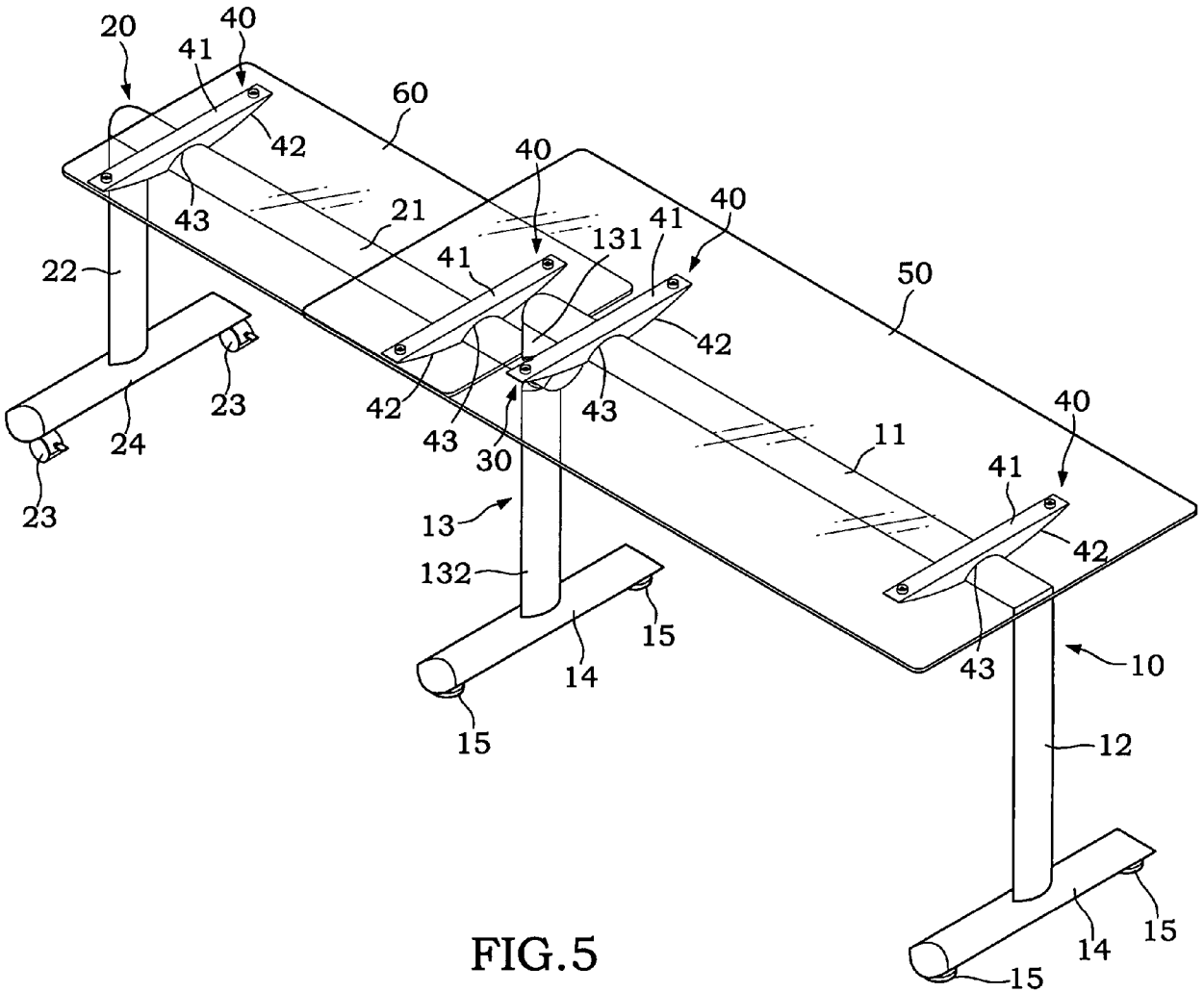
FIG. 5 is a second perspective view of the present invention.
Figure 6:
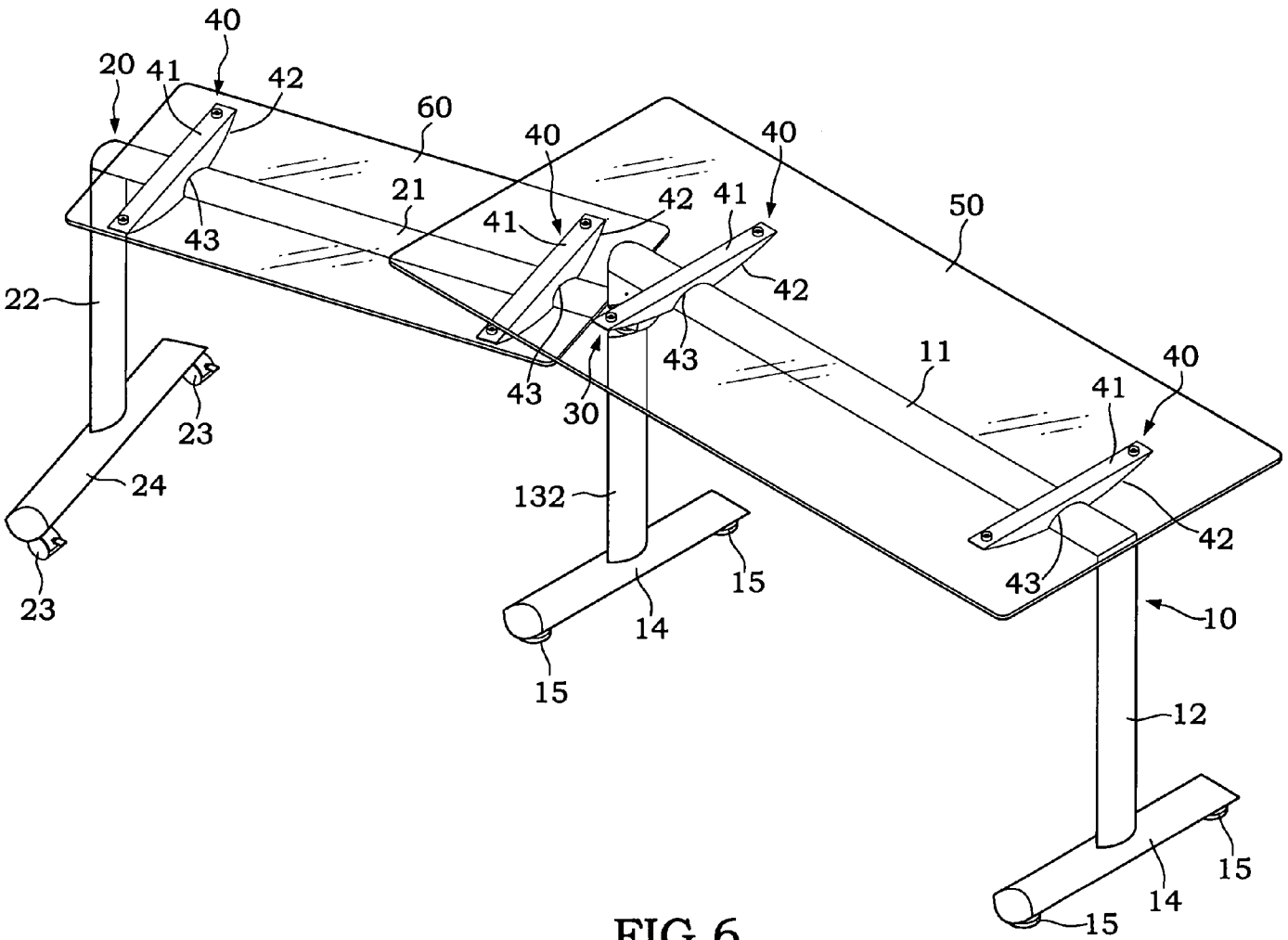
FIG. 6 is a third perspective view of the present invention.
Figure 7:
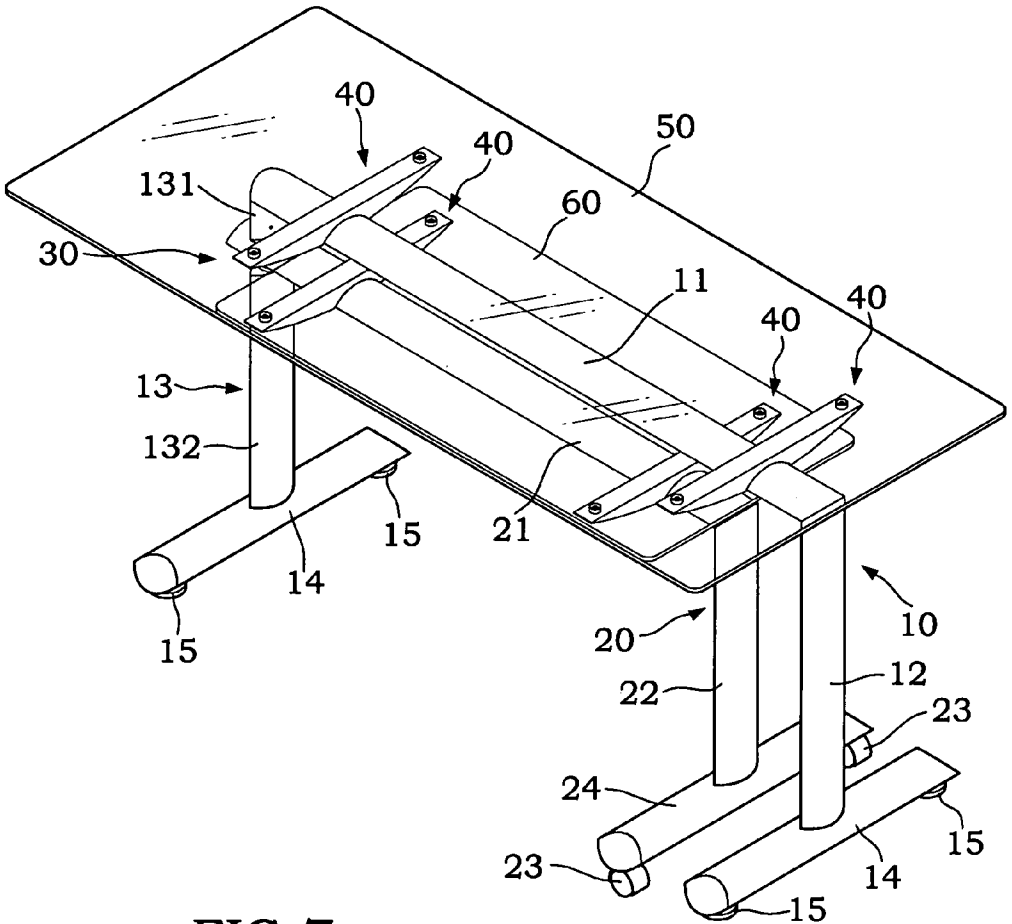
FIG. 7 is a fourth perspective view of the present invention.

Based on the structure described above, the main desk 10 and the extension desk 20 connect in single point rotatably, the top leg 131 and the bottom leg 132 of main leg 13 are connected together with the top ring 34, as the other main leg 12, they are all fix shaft; the extension beam 21 rotates along the round shaft 133 with the connecting tube 31, the top and bottom rub-resistant ring 32, 33 without angle limitation. The main desk 10 and the extension desk 20 can connect in all angles; as shown in FIG. 5, the extension desk 20 can stretch out from the end of the main desk 10; as shown in FIG. 1, the extension desk 20 and the main desk 10 are in "L" shape; as shown in FIG. 6, the extension desk 20 can stretch out from the end of the main desk 10 with any angle; as shown in FIG. 7, the extension desk 20 is under the space of the main desk 10.

The structure of the main and extension desk 10, 20 are simple and strong; one end of the extension desk 20 connects to the main desk 10 with the connection mechanism 30, the other end is supported with the extension leg 22, the extension stretcher 24 and rolling wheel 23 stably, users can move the extension desk 20 open or put away easily.

While a preferred embodiment of the invention has been shown and described in detail, it will be readily understood and appreciated that numerous omissions, changes and additions may be made without departing from the spirit and scope of the invention.

What is claimed is:

1. A movable "L" type desk comprising:

a main desk consists of a main beam with a main leg each on both ends of said main beam and form a rack on floor, a main desk board;

an extension desk consists of an extension beam with an extension leg on one end, the other end of said extension desk connects to one of said main leg of said main desk with a connection mechanism rotatably, a rolling wheel is on the bottom of said extension leg, an extension desk board;

said connection mechanism is to have said main leg connected to said extension leg divide into a top, a bottom leg, top of said top leg connects to said main beam, a round shaft is on top of said bottom leg, a hollow connecting tube is installed vertically near the ope end of said extension beam, at least one rub-resistant ring is inside said connecting tube, said round shaft passes through said rub-resistant ring, the top of said round shaft passes through the said rub-resistant ring and connects to said top leg wherein top of said round shaft passes through said connecting tube and is fixed with a top ring, a wing board extends from the bottom of said top ring, said wing board is fixed on the bottom of said top leg.

2. The movable "L" type desk recited in claim 1, wherein said wing board has two board holes, a shaft hole is on the bottom of said top leg for said top ring and top of said round shaft to pass through, a screw tip with thread each is on both ends of the bottom of said top leg to pass two said board holes and fasten with nuts.

3. The movable "L" type desk recited in claim 1, wherein at least two supporting beams each are installed on top of said main and extension beams vertically, said support beams sustain the bottom of said main and extension desk boards wherein center of the bottom surface of said supporting beam has an indentation trough, a turning-resistant pin is on said indentation trough, a pin hole each is on said main and extension beam at the location for said supporting beam, said turning-resistant pin is inserted into said pin hole, said indentation troughs fit completely onto said main and extension beams.

4. The movable "L" type desk recited in claim 3, wherein said turning-resistant pin has thread, screws are screwed into the thread of said turning-resistant pins from the bottom of said main and extension beams to fix said turning firmly.

5. A connection mechanism comprising:

a main leg of a main desk with a top, and bottom leg, a round shaft is on top of said bottom leg;

an extension leg of an extension desk, a hollow connecting tube is installed vertically near the open end of an extension beam, at least one rub-resistant ring is inside said connecting tube, said round shaft passes through said rub-resistant ring, the top of said round shaft passes through the said rub-resistant ring and connects to said top leg wherein the top of said round shaft passes through said connecting tube and is fixed with a top ring, a wing board extends from the bottom of said top ring, said wing board is fixed on the bottom of said top leg.

6. The movable "L" type desk recited in claim 5, wherein said wing board has two board holes, a shaft hole is on the bottom of said top leg for said top ring and top of said round shaft to pass through, a screw tip with thread each is on both ends of the bottom of said top leg to pass two said board holes and fasten with nuts.

* * * * *